US011650034B1

(12) United States Patent
Hollis et al.

(10) Patent No.: US 11,650,034 B1
(45) Date of Patent: May 16, 2023

(54) INTERNAL CAPTIVE COLLAR JOINT FOR PROJECTILE

(71) Applicant: U.S. Government as Represented by the Secretary of the Army, Dover, NJ (US)

(72) Inventors: Michael Hollis, Flanders, NJ (US); Gary Dundon, Rockaway, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 17/703,605

(22) Filed: Mar. 24, 2022

Related U.S. Application Data

(60) Provisional application No. 63/165,761, filed on Mar. 25, 2021.

(51) Int. Cl.
*F42B 12/20* (2006.01)

(52) U.S. Cl.
CPC ..... *F42B 12/20* (2013.01)

(58) Field of Classification Search
CPC ..... F42B 12/20; F42B 12/207; F42B 12/28; F42B 12/32
USPC ..... 102/374, 439, 440
See application file for complete search history.

(56) References Cited

U.S. PATENT DOCUMENTS 2,998,772 A * 9/1961 Land ..... C06B 45/10 149/19.91
3,183,024 A * 5/1965 Myers ..... F42B 15/36 285/332
4,348,956 A * 9/1982 Schmidlin ..... F16B 7/0413 403/321
4,516,499 A * 5/1985 Eyman ..... F42B 15/36 102/377
4,745,861 A * 5/1988 Fenton ..... F02K 9/30 102/377
4,771,696 A * 9/1988 Smolnik ..... F42B 30/003 102/293
4,962,706 A * 10/1990 Ivermee ..... F42C 11/065 102/206
5,394,803 A * 3/1995 Mort ..... F42B 15/36 102/377
5,483,894 A * 1/1996 Facciano ..... F42B 15/00 102/377
6,113,410 A * 9/2000 Heit ..... H01R 9/0503 439/321
6,640,720 B1 * 11/2003 Biserod ..... F15B 15/22 102/377
8,894,011 B1 * 11/2014 Guerquin ..... B29C 65/561 244/119
9,933,097 B2 * 4/2018 Buttolph ..... F42B 15/36
(Continued)

*Primary Examiner* — John Cooper
(74) *Attorney, Agent, or Firm* — John P. DiScala

(57) ABSTRACT

Components of a projectile are held together by a captive collar that is internal to the projectile. The internal captive collar is rotated about a central boss, allowing external threads on the collar to engage one of the mating components and pull that mating component into the other mating component in an axial only translation. The internal captive collar is rotated using a geared-key during assembly. This key engages a geared crown feature of the captive collar, allowing it to rotate. After assembly, the gear key is removed from the assembly. Castellated features nest within slots to transmit torque in the assembled projectile.

16 Claims, 8 Drawing Sheets

(56) References Cited

U.S. PATENT DOCUMENTS

| | | | | |
|---|---|---|---|---|
| 10,222,189 | B2 * | 3/2019 | Reimann | F42B 15/36 |
| 10,337,845 | B2 * | 7/2019 | Jansson | F42B 12/625 |
| 10,634,473 | B2 * | 4/2020 | Travis | F42B 15/36 |

* cited by examiner

INTERNAL CAPTIVE COLLAR JOINT FOR PROJECTILE

CROSS-REFERENCE TO RELATED APPLICATIONS

This application claims the benefit under 35 USC § 119(e) of U.S. provisional patent application 63/165,761 filed on Mar. 25, 2021.

STATEMENT OF GOVERNMENT INTEREST

The inventions described herein may be manufactured, used and licensed by or for the United States Government.

FIELD OF THE INVENTION

The invention relates in general to projectiles and in particular to multi-piece projectiles.

BACKGROUND OF THE INVENTION

Projectile bodies, such as artillery shells, are often assembled from multiple components. The assembled joints must be sufficient to withstand the high forces often experienced by projectiles. Spin-stabilized artillery projectiles, in particular, must survive immense torque loads that are imposed during cannon launch.

Current methods of assembling spin-stabilized artillery projectiles include using a threaded joint with a thread locking adhesive. The threaded joints have to be strong enough to withstand the forces from the release of stored energy during cannon launch. In some cases, a friction-based surface, such as a face knurling, is also used.

There are downsides to this approach. If not done properly, the threads or components fail under tensile load and the joined parts separate at muzzle exit. If the threaded locking adhesive or frictional surface fail, the components rotate which could lead to other issues. In addition, knurled interfaces are difficult to manufacture consistently and the friction is difficult to measure in a dynamic environment. The components tend to over-tighten or slip.

A need exists for a system and method for creating an artillery projectile with multiple components that are easily, yet robustly, joined together.

SUMMARY OF INVENTION

One aspect of the invention is a projectile having a first component, a second component and an internal captive collar. The first component has a castellated region and a stepped down region. The second component has a slotted region, an opening and a threaded region. The slotted region corresponds to the castellated region of the first component. The opening is sized to receive the stepped down region of the first component. The threaded region is along an internal circumference proximate to the opening. The internal captive collar is positioned between the first component and the second component. The internal captive collar is rotatably affixed about the stepped down region of the first component and further comprising a thread along an external circumferential surface. The thread is for interfacing with the threaded region of the second component such that a rotation of the internal captive collar draws the first component and the second component axially closer to each other until the castellated region of the first component interfaces with the slotted region of the second component and axially secures the first component to the second component.

Another aspect of the invention is an artillery projectile including a rocket motor assembly, a warhead component, an internal captive collar, a retaining nut and a gear key. The rocket motor assembly has a generally cylindrical body and further comprises a castellated region proximate an opening in the rocket motor assembly and a threaded region along an internal circumference proximate to the opening. The warhead component has a generally cylindrical body. The warhead component body further comprises a slotted region and a stepped down region. The slotted region corresponds to the castellated region of the first component. The stepped down region comprises a thread along its exterior surface. The stepped down region is sized and dimensioned for being received within the opening of the rocket motor assembly. The internal captive collar is positioned about the stepped down region of the warhead component. The internal captive collar further comprises a threaded region about an external circumferential surface and a crown gear about its face. The threaded region is for interfacing with the threaded region of the rocket motor assembly for drawing said rocket motor assembly axially closer to the warhead component. The rocket motor assembly is drawn closer to the warhead component until the stepped down region is inserted into the rocket motor assembly and the castellated region of the rocket motor assembly interfaces with the slotted region of the warhead. The internal captive collar secures the rocket motor assembly and the warhead component axially relative to each other. The retaining nut is axially aligned with and surrounded by the internal captive collar. The retaining nut is threaded around the stepped down region of the warhead component. The retaining nut captures the internal captive collar about the stepped down region and prevents axial translation of the captive collar. The gear key has a geared surface for interfacing with the crown gear such that a rotation of the gear key rotates the internal captive collar about the retaining nut. The gear key accesses the crown gear of the internal captive collar through an opening in between the rocket motor assembly and the warhead component.

Another aspect of the invention is a method for assembling a projectile. The method comprises the steps of: providing a first component and a second component to be joined, said first component further comprising a castellated region and a stepped down region and said second component further comprising a slotted region corresponding to said castellated region of the first component, an opening sized to receive the stepped down region of the first component and a threaded region along an internal circumference proximate to the opening; rotatably affixing an internal captive collar around the stepped down region of the first component, said internal captive collar further comprising a thread along an external circumferential surface for interfacing with the threaded region of the second component; axially aligning the first component and the second component such that the thread of the internal captive collar interfaces with the thread of the second component; drawing the stepped down region into the opening of the second component by rotating the internal captive collar about the stepped down region; and inserting the stepped down region into the second component until the castellated region interfaces with the slotted region.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A safe and reliable multi-component projectile enables cost effective manufacturing and assembly of the projectile. Artillery projectiles have to withstand large accelerations, both during launch, set-back, and during muzzle exit, set-forward, when the stored potential energy of the projectile is released. Locking the union from axial translation requires a means of the components butting up against each other. Major components of the projectile are joined by an internal captive collar which both draws the components together axially and then holds them together. When assembled, castellation features on one component mate with corresponding slots on the other component and serve to transmit torque.

The components are held together by a captive collar that is internal to the projectile. The internal captive collar is rotated about a central boss, allowing external threads on the collar to engage one of the mating components and pull that mating component into the other mating component in an axial only translation. The internal captive collar is rotated using a geared-key during assembly. This key engages a geared crown feature of the internal captive collar, allowing it to rotate. After assembly, the gear key is removed from the assembly. Castellated features nest within slots to transmit torque in the assembled projectile.

Throughout this specification, the projectile is illustrated in the context of an artillery projectile. More specifically, the specification describes a union between a warhead of an artillery projectile and a rocket motor of an artillery projectile. However, those skilled in the art will recognize that while the projectile and related methods of assembly are suited for an artillery projectile, the projectile and methods of assembly are not limited to artillery projectiles. Rather, the projectile may be any projectile in which two components, a fore portion and an aft portion, must be joined to create the body of the projectile. Further, while the invention is particularly suited to spin-stabilized projectiles, it is not limited to spin-stabilized projectiles.

Figure 1:
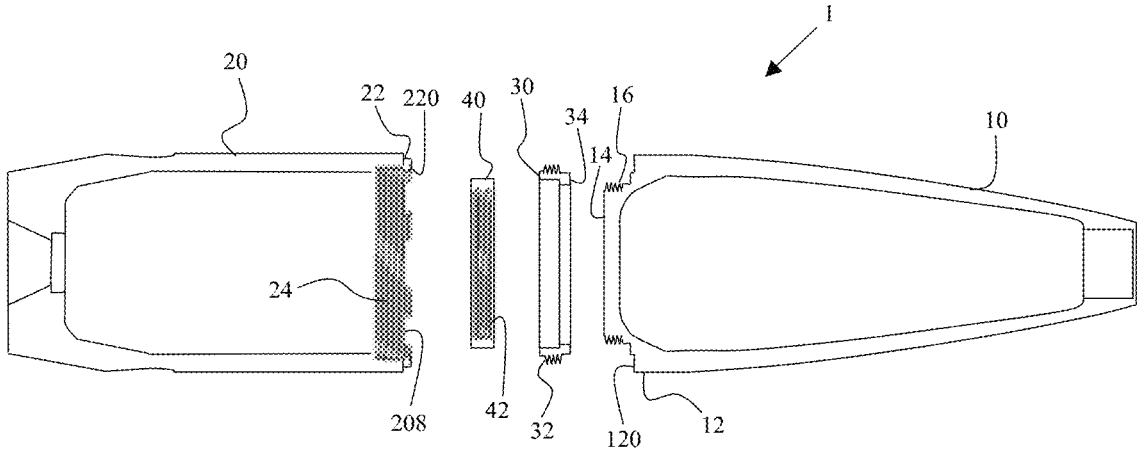
FIG. 1 is an exploded section view of the artillery projectile, according to an illustrative embodiment.
Figure 2:
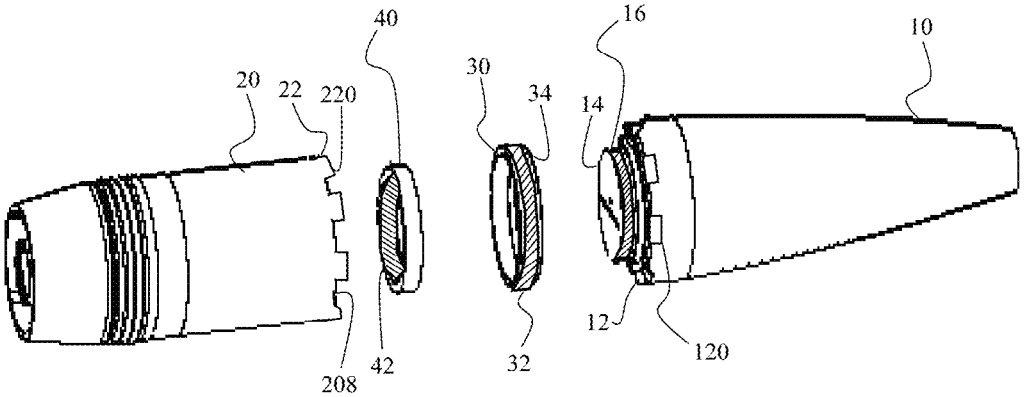
FIG. 2 is an exploded perspective view of the artillery projectile, according to an illustrative embodiment.

FIG. 1 is an exploded section view of the artillery projectile, according to an illustrative embodiment. FIG. 2 is an exploded perspective view of the artillery projectile, according to an illustrative embodiment. The artillery projectile is a spin stabilized artillery projectile. Spin stabilized, in this context, means the projectile leaves the muzzle spinning at a rate of 100 Hertz (Hz) to over 300 Hz. The artillery projectile is launched from ignited propellant producing sufficient pressure to propel the artillery projectile 1 through a cannon tube. The artillery projectile comprises a warhead component 10, a rocket motor assembly 20, an internal captive collar 30, a retaining nut 40 and a geared key 50.

The warhead component 10 and rocket motor assembly 20 both comprise generally cylindrical bodies. The warhead component 10 may taper toward the muzzle end of the component thereby forming a conical cylindrical body. A stepped down region 14 of the warhead component 10 is dimensioned to be received within an opening 208 at the front of the rocket motor assembly 20. The rocket motor assembly 20 further comprises a castellated region 22 proximate the opening 208 with teeth 220 defined by a face of the rocket motor assembly 20.

Figure 3:
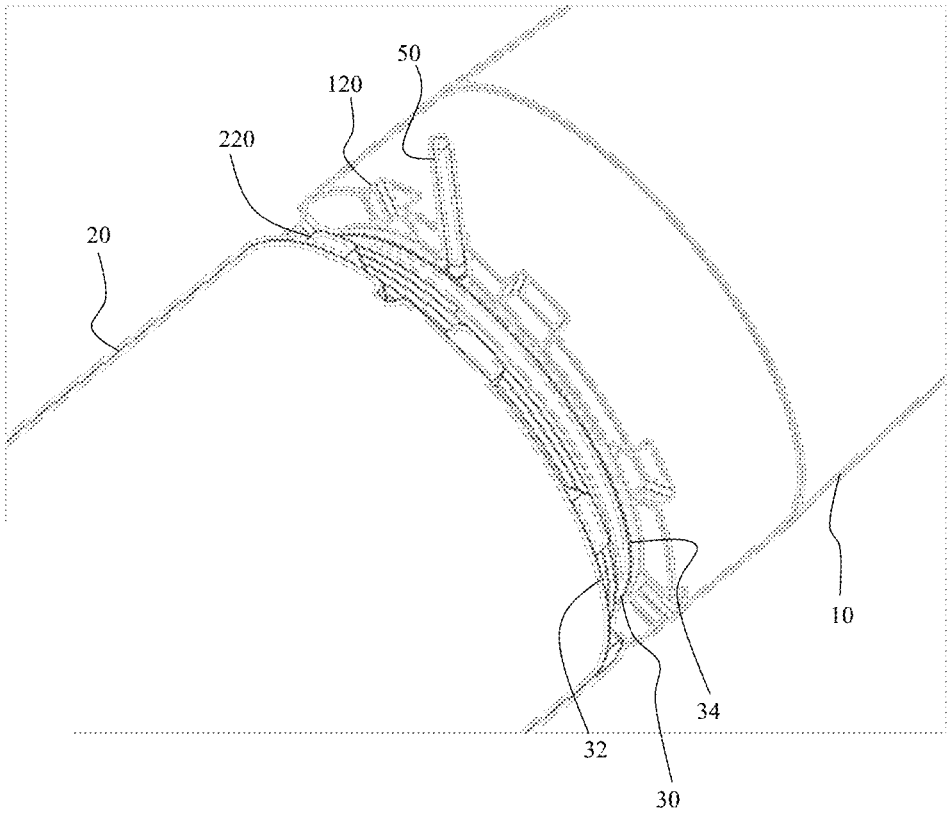
FIG. 3 is a detailed view of the joint between the rocket motor assembly and the warhead component in an unassembled state, according to an illustrative embodiment.
Figure 4:
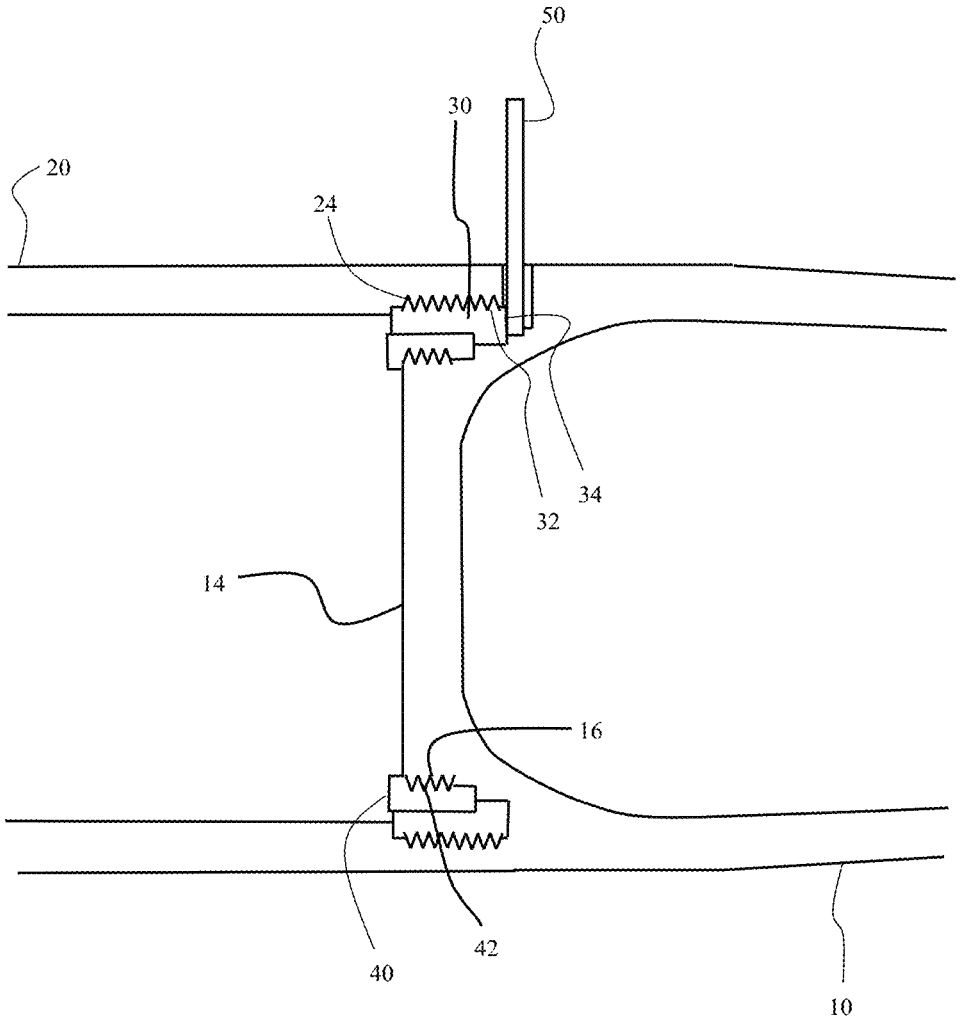
FIG. 4 is a section view of the joint between the rocket motor assembly and the warhead component, according to an illustrative embodiment.

FIG. 3 is a detailed view of the joint between the rocket motor assembly and the warhead component in an unassembled state, according to an illustrative embodiment. FIG. 4 is a section view of the joint between the rocket motor assembly and the warhead component, according to an illustrative embodiment. When inserted into the rocket motor assembly 20, a castellated region 22 of the rocket motor assembly 20 mates with a slotted region 12 of the warhead component 10. The exterior surfaces of the warhead component 10 and the rocket motor assembly 20 when assembled, form a relatively flush surface with each other.

The retaining comprises a thread 42 about an internal circumferential surface. The retaining nut 40 threads onto a threaded region 16 of the warhead component 10, capturing the internal captive collar 30 about a cylindrical stepped down region 14 on the warhead component 10. The retaining nut 40 eliminates any axial translation in the internal captive collar 30, only allowing rotation about a cylindrical stepped down region 14 of the mating assembly.

Figure 5:
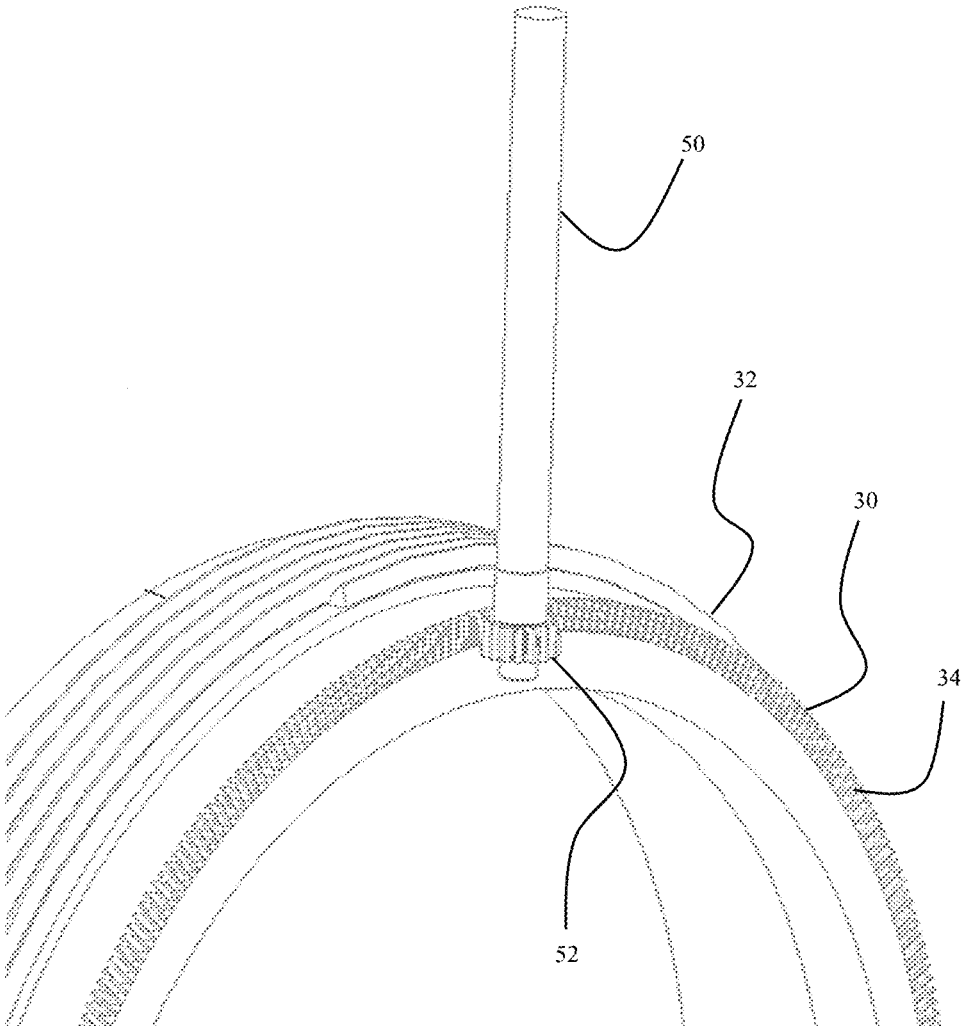
FIG. 5 is a detailed view of the internal captive collar and the gear key, according to an illustrative embodiment.

FIG. 5 is a detailed view of the internal captive collar and the gear key, according to an illustrative embodiment. The internal captive collar 30 further comprises external threads 32 defined by an exterior circumferential surface. The internal captive collar 30 further comprises a crown gear 34 defined by a face of the internal captive collar 30.

The rotation of the internal captive collar 30 allows external threads 32 to engage with the other mating assembly, thus translating it with respect to the projectile axis and nesting the castellation teeth 220 into the mating slots 120. In the embodiment shown, the rocket motor assembly 20 further comprises internal threads 24 defined by an interior circumferential surface proximate the opening 208. The external threads 32 of the internal captive collar 30 interface with the internal threads 24 of the rocket motor assembly 20 to assemble and retain the mating components 10, 20.

Rotation of the internal captive collar 30 is accomplished by a geared key 50 that is used only at assembly. The geared key 50 comprises a geared region on an exterior circumferential surface which interfaces with the internal captive collar 30 via the crown gear 34. This geared key 50 can apply the required torque for maintaining the joint during launch and flight of the projectile.

The geared key 50 is only used at assembly and removed after assembly. The geared key 50 is inserted and removed through an opening between the warhead component 10 and the rocket motor assembly 20. A tool, such as an air tool, may be used to turn the geared key 50 and apply torque required to thread the internal captive collar 30 into the rocket motor assembly 20.

Figure 6:
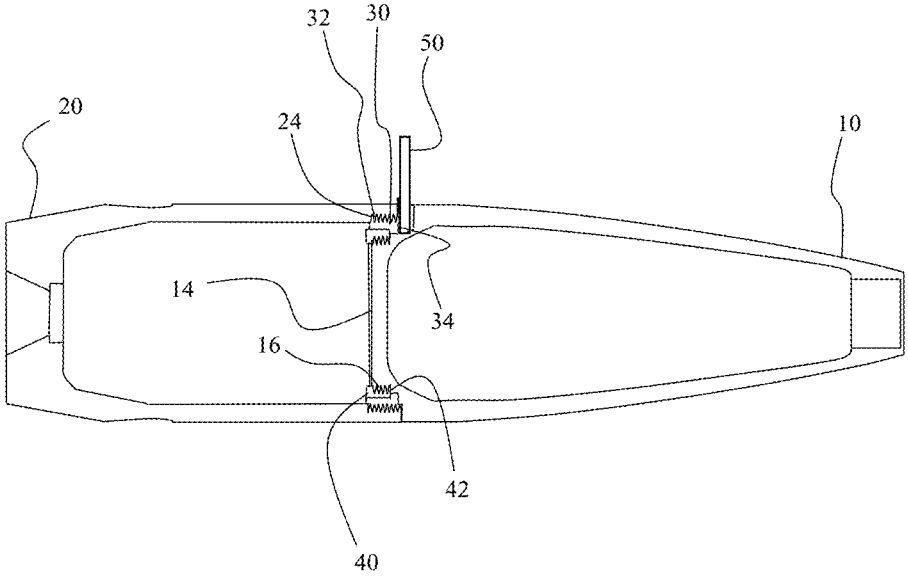
FIG. 6 is a section view of the assembled artillery projectile with the gear key, according to an illustrative embodiment.
Figure 7:
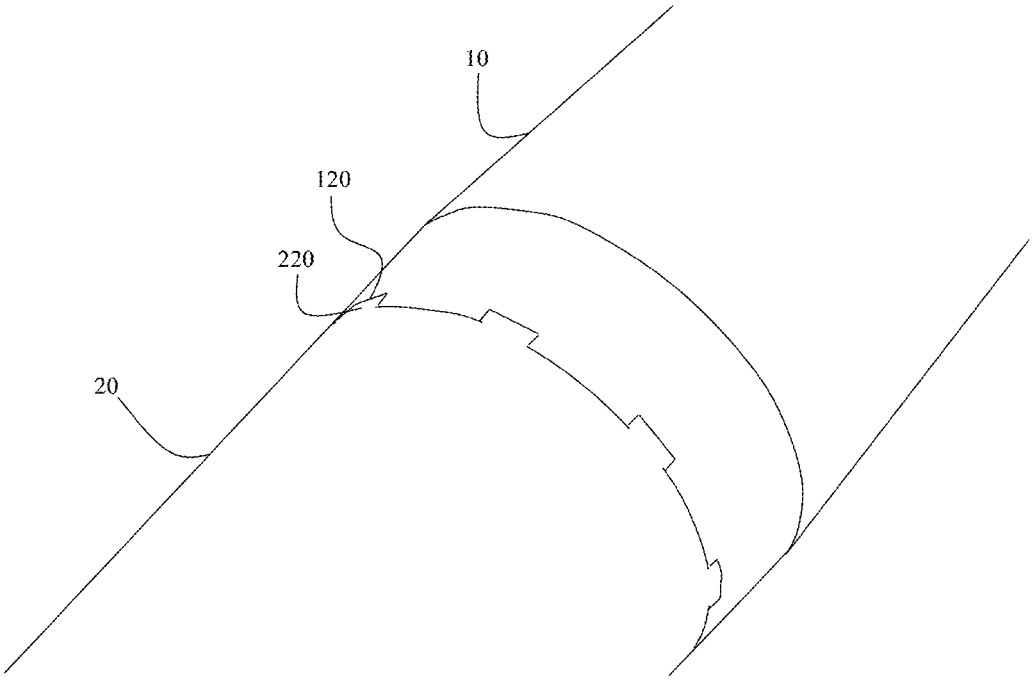
FIG. 7 is detailed perspective view of the joint between the rocket motor assembly and the warhead component in an unassembled state, according to an illustrative embodiment.

FIG. 6 is a section view of the assembled artillery projectile with the geared key 50, according to an illustrative embodiment. FIG. 7 is detailed perspective view of the joint between the rocket motor assembly and the warhead component in an assembled state, according to an illustrative embodiment. As the geared key 50 is turned, the internal captive collar 30 turns due to the crown gear 34 and geared key 50 interface. As the internal captive collar 30 turns, it pulls the rocket motor assembly 20 up, allowing the teeth to mesh with the slots 120. The body of the rocket motor assembly 20 never rotates, as it only translates axially. The projectile has a flat-on-flat interface between the warhead component 10 and the rocket motor assembly 20 which is required to withstand the acceleration forces from cannon launch.

Figure 8:
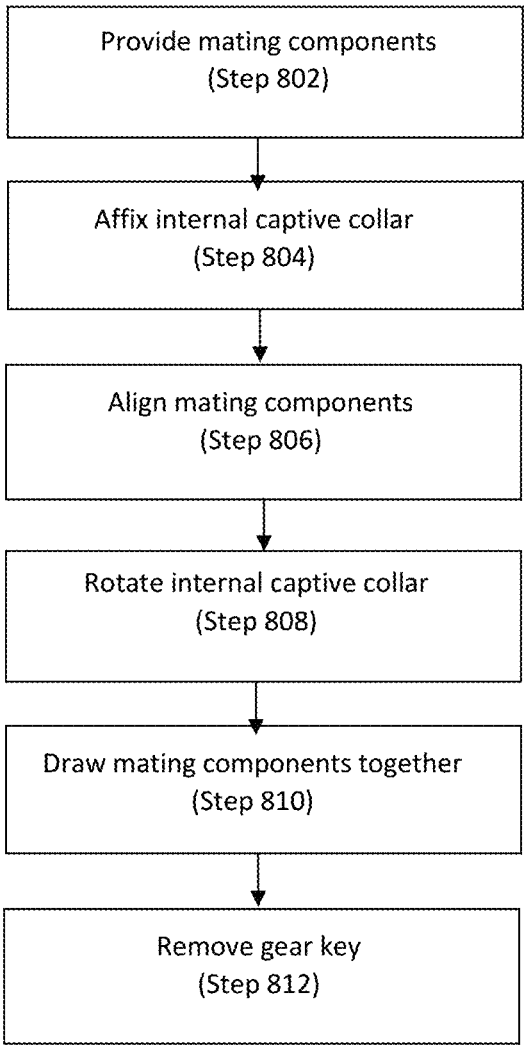
FIG. 8 is a flowchart illustrating a method for assembling a projectile, according to an illustrative embodiment.

FIG. 8 is a flowchart illustrating a method for assembling a projectile, according to an illustrative embodiment. At step 802, a warhead component 10 and a rocket motor assembly 20 are provided.

At step 804, the internal captive collar 30 is affixed to the stepped down region 14 of the warhead component 10 by the retaining nut 40 such that it is axially restrained but free to rotate about the stepped down region 14.

At step 806, the warhead component 10 and the rocket motor assembly 20 are axially aligned such that the exterior thread 32 of the internal captive collar 30 is aligned with the internal thread 24 of the rocket motor assembly 20.

At step 808, the internal captive collar 30 is rotated about the stepped down region 14 of the warhead component 10 by the geared key 50. The rotation of the internal captive collar 30 draws the rocket motor assembly 20 toward the internal captive collar 30 and thereby the stepped down region 14 of the warhead component 10.

At step 810, the rocket motor assembly 20 and the warhead component 10 are drawn together axially until the castellated region 22 of the rocket motor assembly 20 mates with the slotted region 12 of the warhead component 10. Teeth of the castellated region 22 insert into slots 120 of the slotted region 12.

At step 812, the geared key 50 is removed through an opening between and defined by the rocket motor assembly 20 and the warhead component 10.

While the invention has been described with reference to certain embodiments, numerous changes, alterations and modifications to the described embodiments are possible without departing from the spirit and scope of the invention as defined in the appended claims, and equivalents thereof.

What is claimed is:

1. A projectile comprising a first component further comprising a castellated region and a stepped down region;

a second component further comprising a slotted region corresponding to said castellated region of the first component, an opening sized to receive the stepped down region of the first component and a threaded region along an internal circumference proximate to the opening; and an internal captive collar positioned between the first component and the second component, said internal captive collar rotatably affixed about the stepped down region of the first component and further comprising a thread along an external circumferential surface for interfacing with the threaded region of the second component such that a rotation of the internal captive collar draws said first component and said second component axially closer to each other until the castellated region of the first component interfaces with the slotted region of the second component and axially secures the first component to the second component.

2. The projectile of claim 1 wherein the projectile is an artillery projectile.

3. The projectile of claim 2 wherein the first component is a warhead component and the second component is a rocket motor assembly.

4. The projectile of claim 1 wherein the projectile is a spin stabilized projectile.

5. The projectile of claim 1 further comprising a gear key for rotating the internal captive collar thereby drawing the first component and the second component closer to each other.

6. The projectile of claim 5 wherein the internal captive collar further comprises a crown gear for interfacing with a geared surface of the gear key.

7. The projectile of claim 6 wherein the gear key accesses the crown of the internal captive collar through an opening between the first component and the second component.

8. The projectile of claim 1 wherein the projectile further comprises a retaining nut axially aligned with and surrounded by the internal captive collar, said retaining nut attached to the stepped down region of the first component and capturing the internal captive collar about the stepped down region and preventing axial translation of the captive collar.

9. The projectile of claim 8 wherein the stepped down region comprises a thread and the retaining nut is threaded onto the stepped down region.

10. An artillery projectile comprising a rocket motor assembly having a generally cylindrical body, said rocket motor assembly body further comprising a castellated region proximate an opening in the rocket motor assembly and a threaded region along an internal circumference proximate to the opening;

a warhead component having a generally cylindrical body, said warhead component body further comprising a slotted region corresponding to said castellated region of the first component a stepped down region comprising a thread along its exterior surface, said stepped down region sized and dimensioned for being received within the opening of the rocket motor assembly;

an internal captive collar positioned about the stepped down region of the warhead component and further comprising a threaded region about an external circumferential surface and a crown gear about a face, said threaded region for interfacing with the threaded region of the rocket motor assembly for drawing said rocket motor assembly axially closer to the warhead component until the stepped down region is inserted into the rocket motor assembly and the castellated region of the rocket motor assembly interfaces with the slotted region of the warhead component and for securing the rocket motor assembly and the warhead component axially relative to each other;

a retaining nut axially aligned with and surrounded by the internal captive collar, said retaining nut threaded around the stepped down region of the warhead component and capturing the internal captive collar about the stepped down region and preventing axial translation of the captive collar; and a gear key comprising a geared surface for interfacing with the crown gear such that a rotation of the gear key rotates the internal captive collar about the retaining nut, said gear key accessing the crown of the internal captive collar through an opening in between the rocket motor assembly and the warhead component.

11. The projectile of claim 10 wherein the projectile is an artillery projectile.

12. The projectile of claim 10 wherein the projectile is a spin stabilized projectile.

13. A method for assembling a projectile comprising the steps of:

providing a first component and a second component to be joined, said first component further comprising a castellated region and a stepped down region and said second component further comprising a slotted region corresponding to said castellated region of the first component, an opening sized to receive the stepped down region of the first component and a threaded region along an internal circumference proximate to the opening;

rotatably affixing an internal captive collar around the stepped down region of the first component, said internal captive collar further comprising a thread along an external circumferential surface for interfacing with the threaded region of the second component;

axially aligning the first component and the second component such that the thread of the internal captive collar interfaces with the thread of the second component;

drawing the stepped down region into the opening of the second component by rotating the internal captive collar about the stepped down region; and inserting the stepped down region into the second component until the castellated region interfaces with the slotted region.

14. The method of claim 13 wherein the internal captive collar further comprises a crown gear defined by a face of the internal captive collar and the step of drawing the stepped down region into the opening of the second component by rotating the internal captive collar about the stepped down region further comprises the step of inserting a gear key into an opening defined between the first component and the second component, said gear key comprising a gear for interfacing with the crown gear of the internal captive collar such that a rotation of the gear key rotates the internal captive collar about the stepped down region.

15. The method of claim 14 further comprising the step of removing the gear key from the opening defined between the first component and the second component.

16. The method of claim 14 wherein the step of rotatably affixing the internal captive collar around the stepped down region of the first component further comprises the steps of inserting the internal captive collar over the stepped down region and axially securing the internal captive collar with a retaining nut.

* * * * *